United States Patent [19]

Greenhow et al.

[11] 4,111,340

[45] Sep. 5, 1978

[54] POURING SPOUT FOR THREADED NECK CONTAINERS

[76] Inventors: Geoffrey Greenhow, 1019 Scenic Dr., Hamilton, Ontario, Canada, L9C1H8; Peter N. Greenhow, 305 W. Jackson St., Bourbon, Ind. 46504

[21] Appl. No.: 564,030

[22] Filed: Apr. 1, 1975

[51] Int. Cl.[2] ..... B65D 25/48

[52] U.S. Cl. ..... 222/527; 222/567

[58] Field of Search ..... 222/526, 527, 567, 570, 222/574, 536

[56] References Cited

U.S. PATENT DOCUMENTS

| | | | |
|---|---|---|---|
| 1,497,350 | 6/1924 | St. Clair | 222/536 |
| 1,660,654 | 2/1928 | Nicholls | 222/570 X |
| 1,950,505 | 3/1934 | Matters | 222/567 X |
| 2,684,793 | 7/1954 | Warrick | 222/567 |
| 3,181,742 | 5/1965 | Kebert | 222/527 |
| 3,726,447 | 4/1973 | Klygis | 222/567 |

*Primary Examiner*—Robert B. Reeves
*Assistant Examiner*—David A. Scherbel
*Attorney, Agent, or Firm*—Wendell E. Miller

[57] ABSTRACT

A container and pouring spout assembly is provided in which a pouring spout of resilient material cross threadedly and sealably engages a threaded filler neck. In one embodiment, the pouring spout comprises a rectangular sheet of plastic having first and second edges, a filler neck opening intermediate the first and second edges, and a trough that is formed by securing a portion of the first edge to a portion of the second edge.

7 Claims, 11 Drawing Figures

POURING SPOUT FOR THREADED NECK CONTAINERS

BACKGROUND OF THE INVENTION

1. Field of the Invention

This invention generally relates to pouring spouts for containers of the filler neck type, and more particularly to pouring spouts for containers having threaded filler necks.

2. Description of the Prior Art

It has been an object of prior art to provide a pouring spout that sealably engages the threads of a threaded neck container and that is rotatable about the longitudinal axis of the threaded neck. Early art includes Lambert, U.S. Pat. Nos. 1,515,219, and Morse, 1,607,774. It has been an object of other prior art to provide a pouring spout in which the pouring spout snaps onto a non-threaded filler neck of the container. Such prior art includes Nicholls, U.S. Pat. Nos. 1,660,654, and Johnson, 2,291,230.

The present invention is advantageous over the above-cited art in that, in the present invention, the pouring spout snaps over and sealably engages threads of a threaded neck container. In addition, Applicant's invention is swivelably rotatable about the neck of the container due to the resiliency of the pouring spout material and thereby provides extreme simplicity in comparison to the above-cited art.

SUMMARY OF THE INVENTION

In accordance with the broader aspects of this invention, there is provided a pouring spout for filler neck type containers and a method of making. In one embodiment of this invention there is provided a pouring spout of resilient sheet material having a filler neck opening therein and having a trough extending from one edge of the pouring spout radially inward toward the filler neck opening.

In another embodiment of this invention there is provided a pouring spout which comprises a rectangular sheet of resilient thermoplastic material having first and second parallel edges distal from each other, having a filler neck opening intermediate of the first and second edges, being folded substantially through the center of the filler neck opening with the first and second edges proximal to each other, and having portions proximal to the first and second edges and another edge securely fused together.

It is a first object of this invention to provide a container and pouring spout assembly that provides effective control of fluid flow.

It is a second object of this invention to provide a pouring spout that is slidably assembled over the filler neck of the container.

It is a third object of this invention to provide a pouring spout that sealably engages the filler neck of a container.

It is a fourth object of this invention to provide a pouring spout of resilient material that sealably engages the threaded filler neck of a container by cross-threaded engagement therewith.

It is a fifth object of this invention to provide a snap-on pouring spout for threaded neck containers.

It is a sixth object of this invention to provide a swivelable pouring spout for threaded neck containers.

It is a seventh object of this invention to provide an inexpensive pouring spout.

It is an eighth object of this invention to provide an inexpensive pouring spout having a relatively large planar surface for the imprinting of an advertising message thereon.

It is a ninth object of this invention to provide a method of manufacturing an inexpensive pouring spout.

The abovementioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
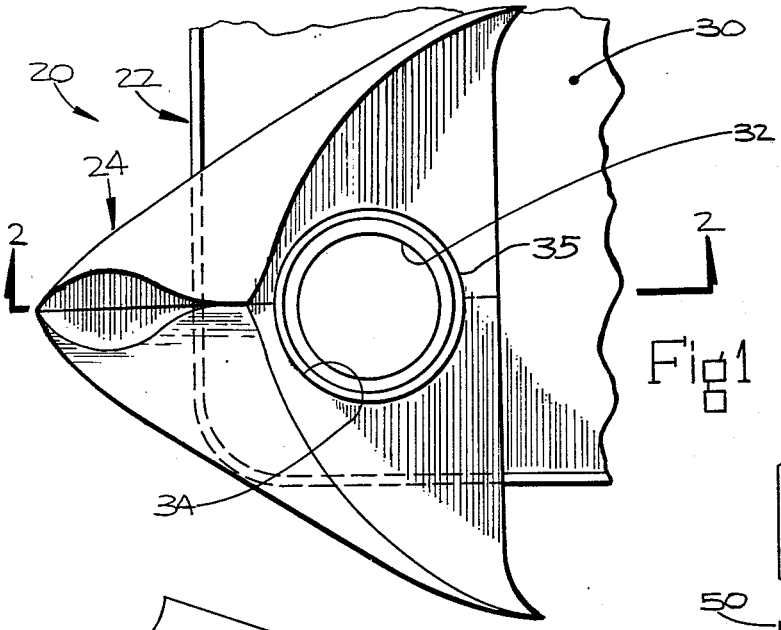
FIG. 1 is a top plan view of a threaded neck type of container with a first embodiment of the pouring spout installed thereupon.
Figure 2:
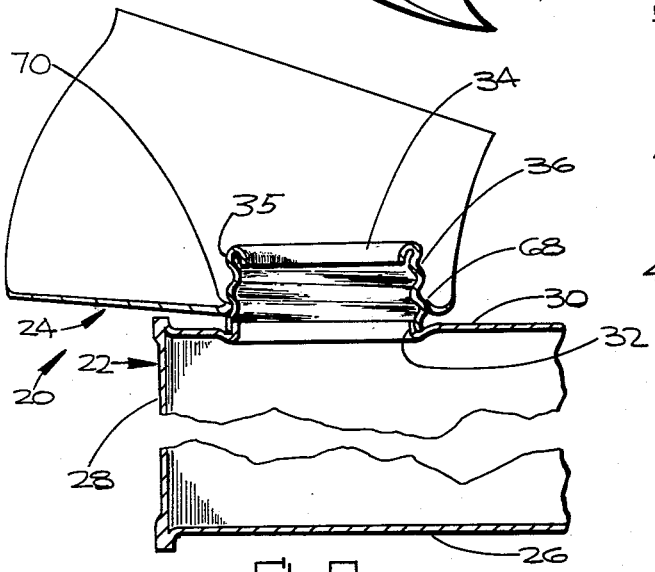
FIG. 2 is a cross-sectional view of FIG. 1 taken substantially as shown by section line 2—2.

Referring now to FIGS. 1 and 2, a container and pouring spout assembly, generally depicted at 20, includes a container 22 and pouring spout 24.

The container 22 includes a bottom wall 26, sidewall means 28, top wall means 30 having a top wall opening 32 therein, and a tubular filler neck 34 being attached to the top wall means 30 in fluid communication with the top wall opening 32 and having an outer cylindrical surface 35 that includes threads 36 thereupon.

Figure 3:
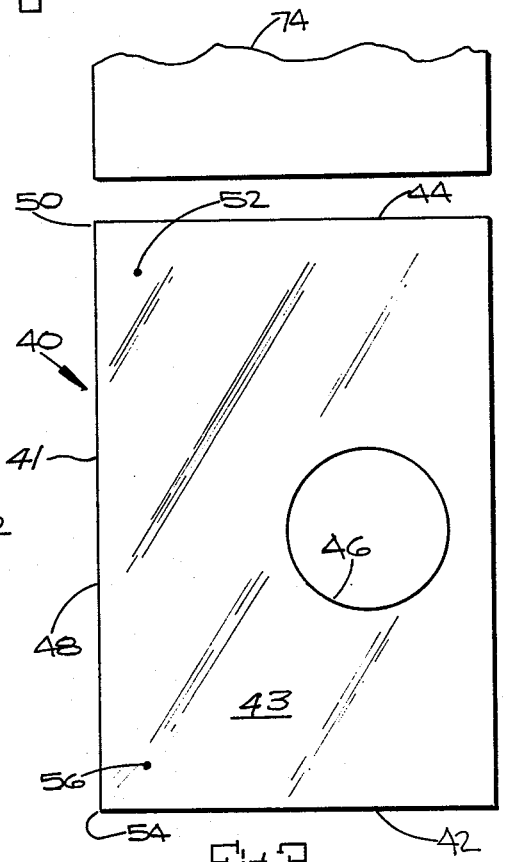
FIG. 3 is the flat pattern for fabricating the pouring spout of FIGS. 1 and 2 and the remainder of a sheet of material from which the flat pattern has been severed.

Referring now to FIG. 3, a rectangular sheet of material 40, which is preferably a thermoplastic material of approximately 0.006 inches thick, provides the flat pattern for the fabrication of the pouring spout 24. The rectangular sheet of material 40 includes circumscribing edge means 41 which comprises a first edge 42, a second edge 44, and one edge 48. The sheet of material 40 further includes a first surface 43, intermediate of the edge means 41, a second surface 45 intermediate of the edge means 41 and in parallel and spaced-apart relationship to the first surface 43, a filler-neck opening or round hole 46, one corner 50 and a first portion 52 of the first surface 43 proximal thereto, and another corner 54 and a second portion 56 of first surface 43 proximal to corner 54 and distal from first portion 52.

Figure 4:
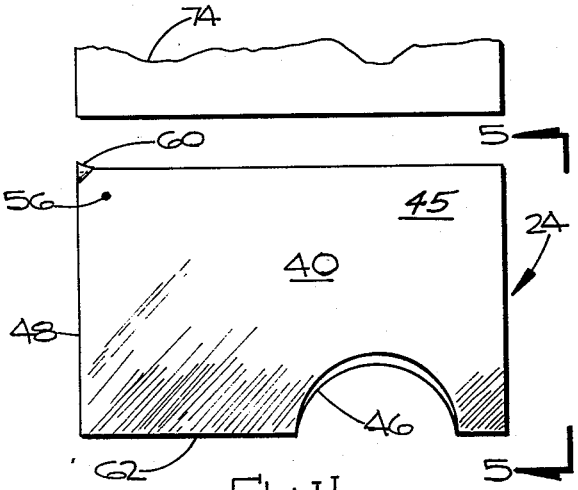
FIG. 4 is a plan view of the pouring spout of FIGS. 1–3, showing the pouring spout as manufactured and before assembling onto the filler neck of a container, and showing the remainder of a sheet of material from which the completed pouring spout has been severed.
Figure 5:
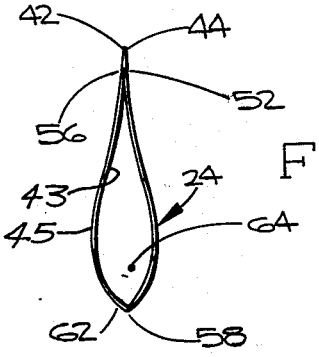
FIG. 5 is an end view of the pouring spout of FIG. 4 taken substantially as shown by view line 5—5.

Referring now to FIGS. 4 and 5, the rectangular sheet of material 40 has been folded substantially through a center 58 of the filler neck opening or hole 46 so that the edges 42 and 44 are in contact and a thermoplastic weld 60 has been used to fuse the portions 52 and 56 of the first surface 43 together. The thermoplastic weld 60 provides a means for attaching or securing the portions 52 and 56 to each other.

It can be seen in FIGS. 4 and 5 that the fold 62 forms a trough 64 from the filler neck opening 46 to the one edge 48 of the rectangular sheet of material 40.

Referring now to FIGS. 1 and 2, in use, the pouring spout 24 is pressed downward over the tubular filler neck 34 by the user's fingers (not shown) or by a suitable mechanical device (not shown); so that the filler neck opening 46 resiliently and sealably engages the threads 36 of the filler neck 34. As can be seen in FIG. 2, the resilient material surrounding the filler neck opening 46 seals at the crest 68 of the threads 36 at a first location around the periphery thereof and seals at the root 70 of the threads 36 at a second location substantially diametrically opposed to the first location or crest sealing location. Thus it can be seen that the resilient material around the filler neck opening 46 is in cross-threaded sealing engagement with the threads 36; and it is due to the resiliency of the material 40 that the filler neck opening 46 sealably engages the threads 36. Since the resiliency of the material 40 has the ability to seal in cross-threaded engagement with the threads 36 it can be seen that the pouring spout 24 can be rotated to direct the trough 64 to deliver fluid at any desired angle from the filler neck 34.

Referring now to FIGS. 3–5, a preferred method of manufacturing the pouring spout 24 includes: producing or blanking the filler neck opening 46, folding the first edge 42 over into engagement with the second edge 44, securing or fusing the portion 52 to the portion 56, and severing or blanking the pouring spout 24 from the remainder of a piece of material 74 which included the rectangular sheet of material 40.

Figure 6:
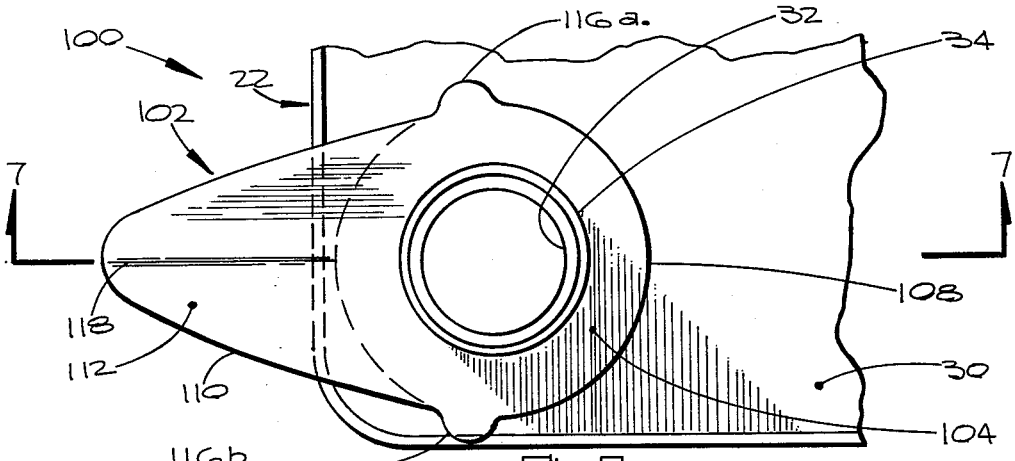
FIG. 6 is a top plan view of a container of the threaded filler neck type showing a second embodiment of the pouring spout installed upon the filler neck.
Figure 7:
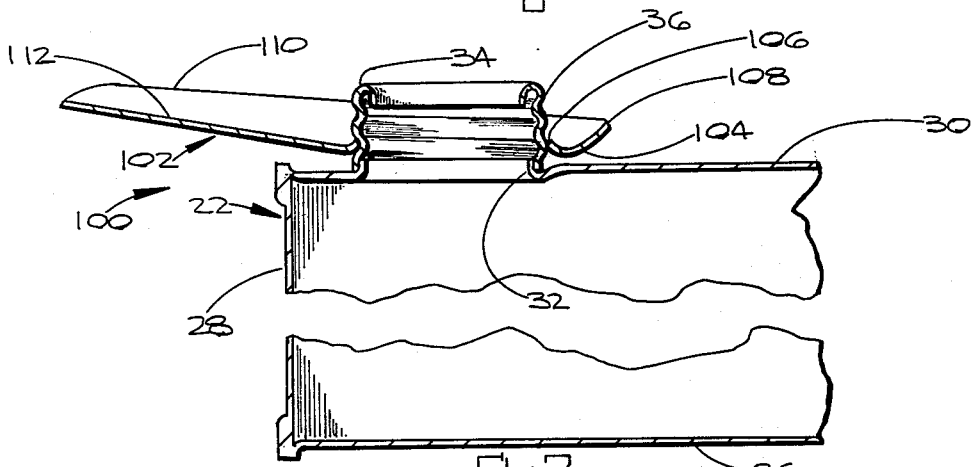
FIG. 7 is a cross-sectional view of FIG. 6 taken substantially as shown by section line 7—7.

Referring now to FIGS. 6 and 7 wherein a second embodiment of the present invention is shown, a container and pouring spout assembly, generally depicted at 100, includes a pouring spout 102 and a container 22 which includes like named and liked numbered parts as the container 22 of FIG. 1.

Figure 9:
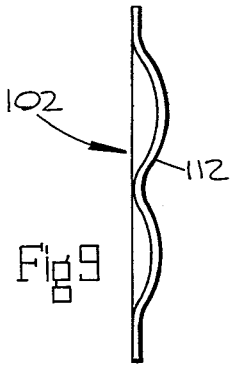
FIG. 9 is an end view of the pouring spout of FIG. 8 taken substantially as shown by view line 9—9.
Figure 8:
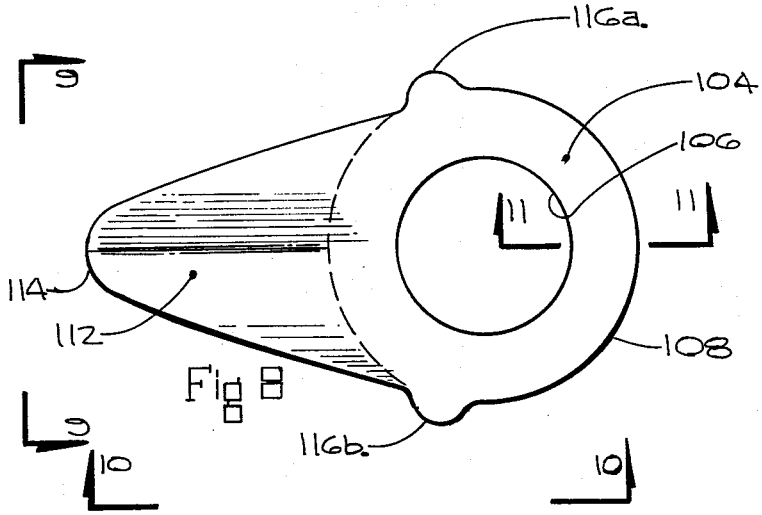
FIG. 8 is a top plan view of the pouring spout of FIGS. 6 and 7.
Figure 10:
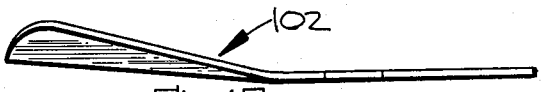
FIG. 10 is a front view of the pouring spout of FIG. 8 taken substantially as shown by view line 10—10.

Referring now to FIGS. 8, 9, and 10, the pouring spout 102 includes a filler-neck engaging collar portion 104 having a filler neck opening 106 therein and an outer periphery 108. The pouring spout 102 also includes an open trough portion 110 which extends radially outward from a part of the periphery 108 of the collar portion 104. The trough portion 110 includes a trough 112 which is formed substantially radially inward from an edge 114 of the trough portion 110 toward the filler neck opening 106. The pouring spout 102 may also include a pair of tabs 116*a* and 116*b*.

Referring again to FIGS. 6 and 7, in operation, the pouring spout 102 is pressed downward over the filler neck 34 by applying pressure to the filler neck engaging collar portion 104, and optionally to the tabs 116*a* and 116*b*. The filler neck opening 106 is preferably sized in relation to the filler neck 34 to provide not only sealable engagement between the filler neck opening 106 and the filler neck 34 but also elastic and/or plastic deformation of the collar portion 104 proximal to the opening 106 so that the collar portion 104 is deformed to a frustoconical shape. As shown in FIG. 7, the periphery 108 of the collar portion 104 can be snapped distal from the top wall means 30 of the container 22 thereby providing a means of preventing fluid flow from the filler neck 34 orthogonally outward across the periphery 108. At the same time, it can be seen that the trough 112 cooperates with the frustoconical shape of the collar portion 104 to facilitate the flow of fluid along a longitudinal axis 118 of the pouring spout 102.

Figure 11:
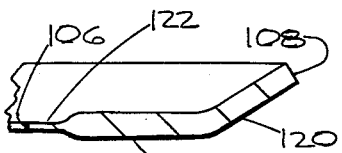
FIG. 11 is a partial and enlarged cross-sectional view taken substantially as shown by section 11—11, showing a modification of the embodiment of FIGS. 8–10.

Referring now to FIG. 11, the outer periphery 108 of the collar portion 104 has been displaced orthogonally outward from the plane of the opening 106 by a frustoconical portion 120 which is radially proximal to the periphery 108; and a thinned annular portion 122 of the collar portion 104 has been provided which is radially proximal to the opening 106.

The orthogonal displacement of the outer periphery 108 by the frustoconical portion 120 provides a means for preventing fluid flow radially outward across the periphery 108 of the collar portion 104; and the thinned annular portion 122 serves to reduce the force that is required to install the pouring spout 102 by increasing the resiliency of the collar portion 104 proximal to the opening 106.

Referring now to FIGS. 8–11, the pouring spout 102 is preferably made from thermoplastic sheet material of 0.020 to 0.030 inches in thickness; and, if the pouring spout 102 is made to the FIG. 11 configuration, the thinned annular portion 122 is preferably made to a thickness of 0.006 to 0.010 inches.

A preferred method of manufacture includes: producing or blanking the opening 106 in a planar sheet of plastic material, forming or thermoforming the trough 112, and severing or blanking the pouring spout 102 from the remainder of the sheet of material. If the pouring spout 102 is manufactured to include the additional details of FIG. 11, the method additionally includes: forming or thermoforming the periphery 108 distal from the plane of the opening 106; and thermoforming or thermopressing the thinned annular portion 122. An optional method of manufacture comprises injection molding.

The pouring spout 102 of FIGS. 8–11 may be installed on the containers 22 by automated equipment (not shown) by the manufacturer of the container 22 or by the company filling the container 22; and, because of the resiliency of the collar portion 104 and the cross-threaded sealing ability of the collar portion 104, the user can swivelably reposition the trough portion 110 for his convenience.

The configuration of FIG. 11 is best suited for installation by the user; since the thinned annular portion 122 greatly reduces the downward force that is required to press the pouring spout 102 down over the filler neck 34 (FIG. 7).

In summary, two embodiments of a pouring spout and a modification of one of the embodiments have been disclosed in which the pouring spout is pressed over a tubular filler neck of a container, the resiliency of the pouring spout material retainably and sealably engages the threads of the filler neck by cross-threaded engagement with the threads of the filler neck, and the resiliency of the material allows rotational positioning of the pouring spout with respect to the container. Both embodiments are economical to manufacture and to use, both may be used disposably, both are compact in design so that they may be packaged fixedly to the top, side, or bottom of a container, and both are compactly suitable for sterile packaging. In addition, the embodiment of FIGS. 1–5 includes a large and flat surface area which is ideally suited for the imprinting of advertising material thereupon. Thus the usefulness, the inherent low cost, and the relatively large amount of imprintable space make the embodiment of FIGS. 1–5 an ideal advertising and promotional item.

While there have been described above the principles of this invention in connection with specific apparatus, it is to be clearly understood that this description is made only by way of example and not as a limitation to the scope of the invention.

What is claimed is:

1. A container and pouring spout assembly which comprises a container of the type having a bottom wall, side wall means upstanding from said bottom wall, top wall means being attached to said side wall means distal from said bottom wall and having a top wall opening therethrough, and a tubular filler neck being sealingly attached to said top wall means in fluid communication with said top wall opening, the improvement which comprises:

said pouring spout comprises a filler-neck engaging collar portion of resilient material that circumscribes a filler-neck opening, that extends radially outward from said filler-neck opening, and that includes an outer periphery;

an open trough portion that is integral with said collar portion, that extends radially outward from a part of said outer periphery, and that includes a trough extending radially outward from said collar portion; and thinned annular portion means of said collar portion, that extends radially outward from said filler-neck opening, for increasing the resiliency of said collar portion.

2. A container and pouring spout assembly as claimed in claim 1 in which said filler-neck opening is sized smaller than said filler neck, whereby said collar portion is deformed to a frustoconical shape when said filler-neck opening is assembled over said filler neck.

3. A container and pouring spout assembly as claimed in claim 1 in which said tubular filler neck includes threads on the outer cylindrical surface thereof, and said circular filler-neck opening is sized to secure said pouring spout onto said tubular filler neck and to seal between said pouring spout and said container by resiliently and cross-threadedly engaging said threads.

4. A container and pouring spout assembly as claimed in claim 3 in which said resilient material is a thermoplastic, said thinned portion is less than 0.015 inches in thickness and said collar portion is more than 0.020 inches in thickness.

5. A pouring spout for containers of the type having a tubular filler neck, which comprises:

said pouring spout comprises a filler-neck engaging collar portion of resilient material that circumscribes a filler-neck opening, that extends radially outward from said filler-neck opening, and that includes an outer periphery;

an open trough portion that is integral with said collar portion, that extends radially outward from a part of said outer periphery, and that includes a trough extending radially outward from said collar portion; and thinned annular portion means of said collar portion, that extends radially outward from said filler-neck opening, for increasing the resiliency of said collar portion.

6. A pouring spout as claimed in claim 5 in which said outer periphery of said collar portion is permanently formed into a plane that is displaced from the plane that is defined by said filler-neck opening.

7. A pouring spout as claimed in claim 6 in which said resilient material is a thermoplastic, said thinned portion is less than 0.015 inches in thickness, and said collar portion is more than 0.020 inches in thickness.

* * * * *